United States Patent [19]

Umebachi et al.

[11] Patent Number: 4,753,466

[45] Date of Patent: Jun. 28, 1988

[54] DOOR LOCKING DEVICE

[75] Inventors: Moriyoshi Umebachi, Minamikachi; Isao Kirigaya, Yokosuka, both of Japan

[73] Assignee: Tokyu Sharyo Seizo Kabushiki Kaisha, Kanagawa, Japan

[21] Appl. No.: 367,585

[22] Filed: Apr. 12, 1982

[30] Foreign Application Priority Data

Apr. 21, 1981 [JP] Japan ..... 56-60332

[51] Int. Cl.[4] ..... E05C 9/08

[52] U.S. Cl. ..... 292/218; 292/DIG. 72

[58] Field of Search ..... 292/218, DIG. 72, DIG. 32

[56] References Cited

U.S. PATENT DOCUMENTS

| | | | |
|---|---|---|---|
| 3,572,794 | 3/1971 | Pastva | 292/218 |
| 3,661,412 | 5/1972 | Morris | 292/218 |
| 4,087,122 | 5/1978 | Shaw et al. | 292/218 |
| 4,235,463 | 11/1980 | Benevenuta | 292/218 |

FOREIGN PATENT DOCUMENTS

| | | | |
|---|---|---|---|
| 1678140 | 2/1980 | Fed. Rep. of Germany | 292/218 |
| 1344181 | 1/1974 | United Kingdom | 292/218 |

*Primary Examiner*—Richard E. Moore

*Attorney, Agent, or Firm*—Bauer & Schaffer

[57] ABSTRACT

A door locking device comprising a cam (3) and cam keeper (4), the cam (3) being provided with a lobe engaging (5), a fork (6) and projecting head (7), the keeper being provided with a U-shaped recess having a hook on one arm and sloped receiving surfaces (4*a*), (4*a*) and (4*c*) provided on the arms of cam keeper (4) engaging respectively with a sloped contacting surface (3*b*) on the upper surface of the lobe (5), a sloped contacting surface (3*c*) on the upper surface of the fork (6) and a sloped contacting surface (3*d*) on the lower surface of the projecting head (7) to effectively distribute loads applied to the door, to improve the durability and to make the door easy to open and close. It can be effectively applied to containers and van type vehicles.

3 Claims, 10 Drawing Sheets

DOOR LOCKING DEVICE

FIELD OF THE INVENTION

This invention relates to door locking devices provided on containers and van type vehicles and more particularly to a locking device strong against an end wall load, i.e., a load applied to a door from within, as well as against a racking load, i.e., a load applied sidewise to this door fitting, thus providing durability as well as a door that is easy to open and close.

BACKGROUND OF THE INVENTION

There has been already provided this kind of door locking device by which doors are formed to be opened from both sides, having a rotatable locking bar provided with cams at the upper and lower ends repsectively of the outside surface of each door and cam keepers engaging respectively with the cams at the upper and lower ends of the locking bar above and below an inlet part, that is, a door frame so as to lock the doors by engaging the cam keepers with the cams.

However, such conventional door locking device have defects which make it weak against the end wall load and racking load, and lacking in the durability. In addition this lock requires a large force to open and close the door.

BRIEF DESCRIPTION OF THE INVENTION

The present invention provides a door locking device comprising a cam and cam keeper so that a force applied to the cam is applied nonuniformly to the cam keeper. This improves the durability and makes the door easy to open and close. Dynamically designed sloped surfaces are formed on the engaging surfaces of the cam and cam keeper. The objects and advantages of the present invention will become apparent from the following specification and drawings.

BRIEF DESCRIPTION OF THE DRAWINGS

The drawings show an embodiment of the present invention.

In the drawings.

DETAILED DESCRIPTION OF THE INVENTION

The drawings show a door locking device of the present invention as applied to a container.

Figure 1:
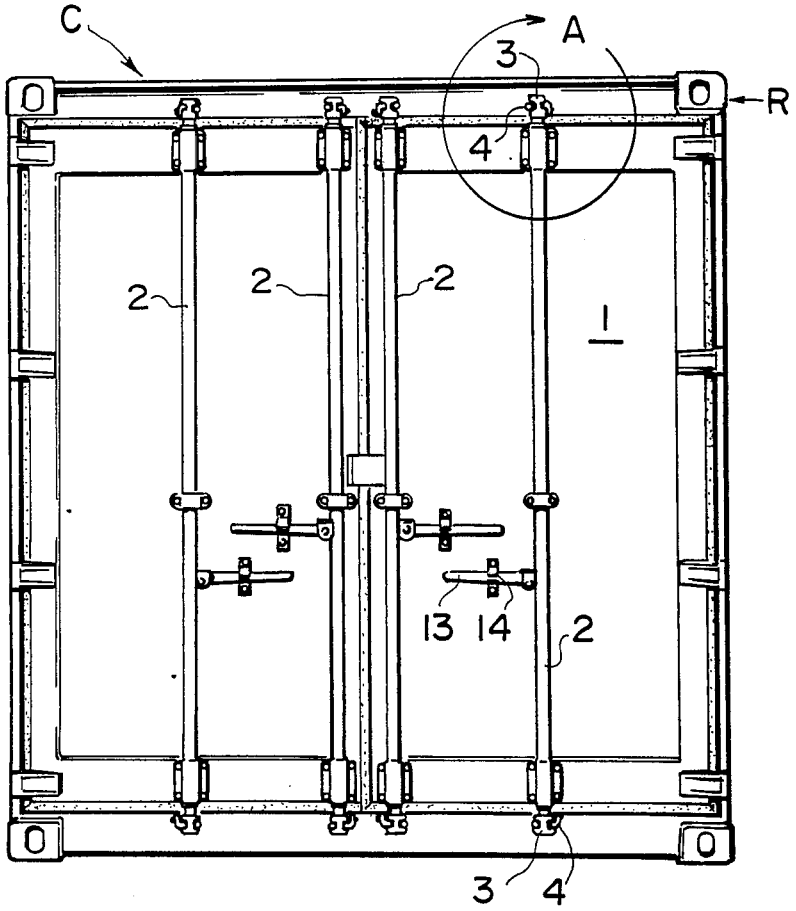
FIG. 1 is a partly sectioned elevation of a door part employing the present invention.

For the door locking devices of the present invention, as shown in FIG. 1, rotatable locking bars 2 are provided on the outside surfaces of doors 1. Cams 3 are provided respectively at the upper and lower ends of the locking bars 2. Cam keepers 4 onto which the cams 3 are filled are provided respectively adjacent the upper and lower ends of the locking bars 2. The cam is mounted on the door frame or fitting part so that the cam keepers 4 will be engaged respectively with the cams 3 when the locking bars 2 are rotated with the respective lock levers 13 while closing the doors 1.

Such door locking device as is mentioned above must endure an end wall load and racking load.

Figure 19:
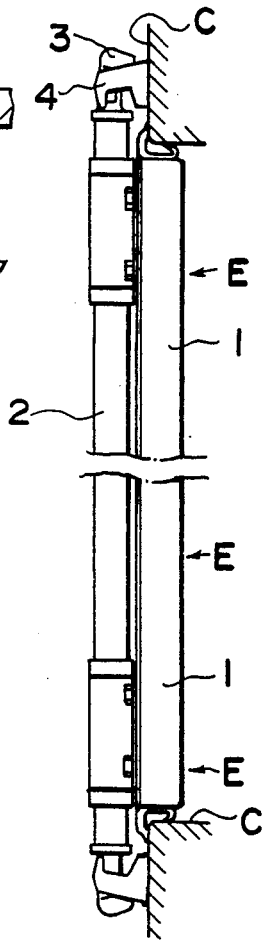
FIG. 19 is a partly omitted vertically sectioned view of the door part.
Figure 17:
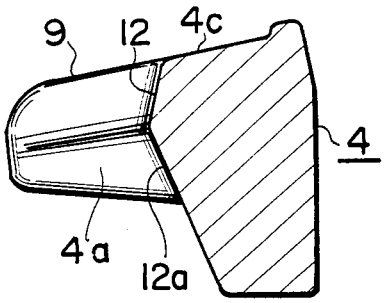
FIG. 17 is a sectioned view along line B—B is FIG. 11.
Figure 3:
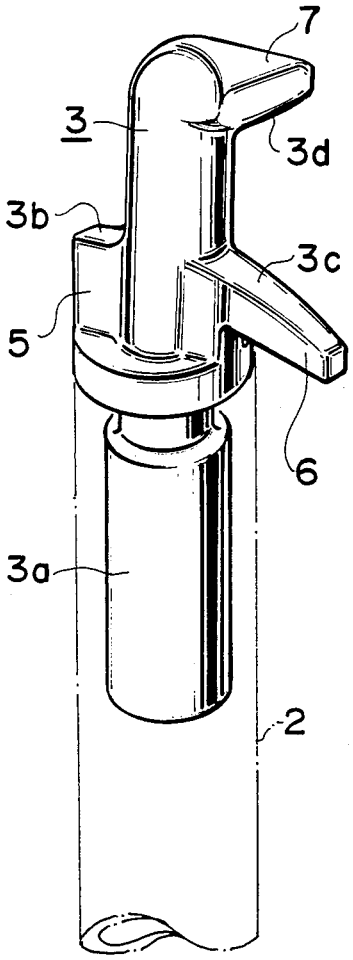
FIG. 3 is a perspective view of the cam of the locking device.

An end wall load is a load applied to the door from within by such bulk items as cereals which load exerts a force in the direction E, as seen in FIG. 19 acting to push the door 1 outwardly.

A racking load is a load applied in the direction R in FIG. 1 as for example that of stacking three of four containers which then act to deform the door 1 and the door from laterally facing them out of their parallelogram construction.

Both of the above mentioned loads are transmitted so complexedly to the cams 3 and cam keepers 4 through the doors 1 and locking bars 2 that the cams 3 and cam keepers 4 are required to be highly durable.

Incidentally the following explanation of the invention is made through a detailed description of a single cam 3 and cam keeper 4 shown in the Section A of FIG. 1. The other cams and keepers are basically the same.

The cam 3 is shown in detail in FIGS. 3 to 9.

The cam 3 according to the present invention is formed by casting or forging of a generally cylindrical bar having a stem 3*a* adapted to be inserted into the locking bar 2 which is conventional formed of a pipe stock. Formed above the stem is an engaging lobe 5 and fork 6 each having sloped contacting surfaces 3*b* and 3*c* fitting the cam keeper 4. This lobe and fork are formed substantially radially outward from each other.

Figure 4:
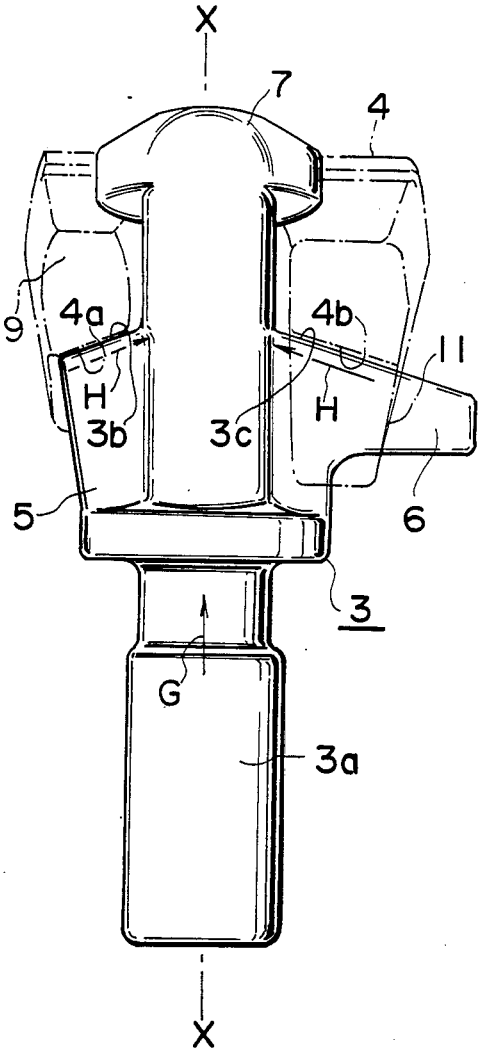
FIG. 4 is a front view of the cam.
Figure 5:
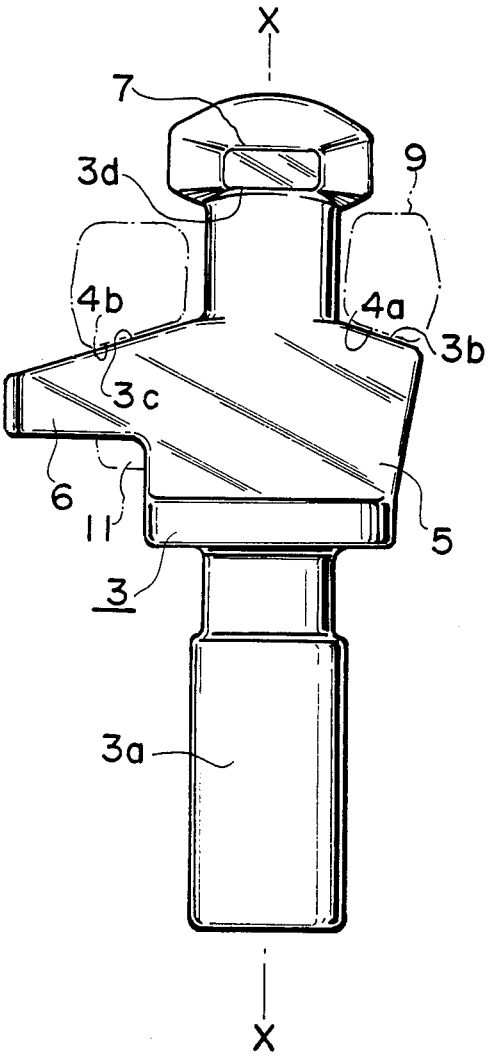
FIG. 5 is a back view of the cam.

As shown in FIGS. 4 and 5, the sloped contacting surfaces 3*b* and 3*c* are inclined at symmetrical angles of inclination from their tips to the central axis X of the bar. At the same time, the sloped contacting surface 3*c* on the fork 6 is inclined in the same manner transversely from the front surface 6*a* to the rear surface 6*b* as shown in FIG. 2.

Figure 2:
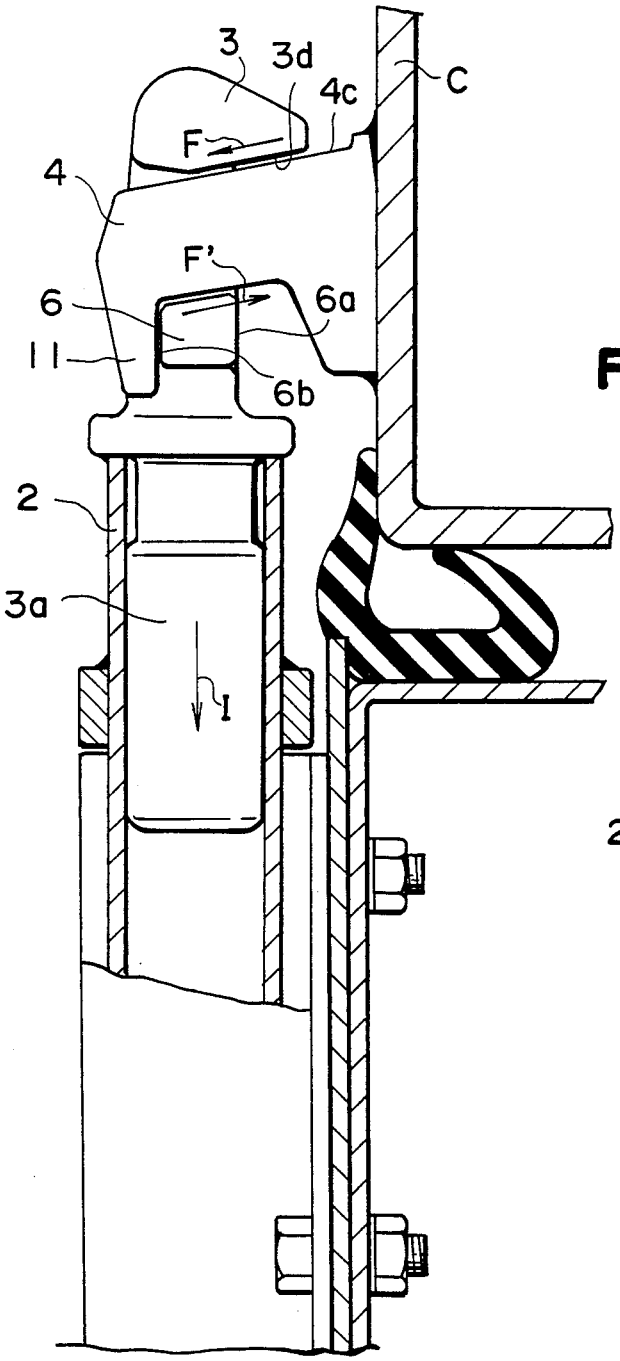
FIG. 2 is a partly sectioned side view of the locking device of the present invention.

Further, projecting over the fork 6 and slightly to the rear is a head 7 having a sloped contacting lower surface 3*d* fitting the upper surface of the cam keeper 4 (FIG. 2).

Figure 6:
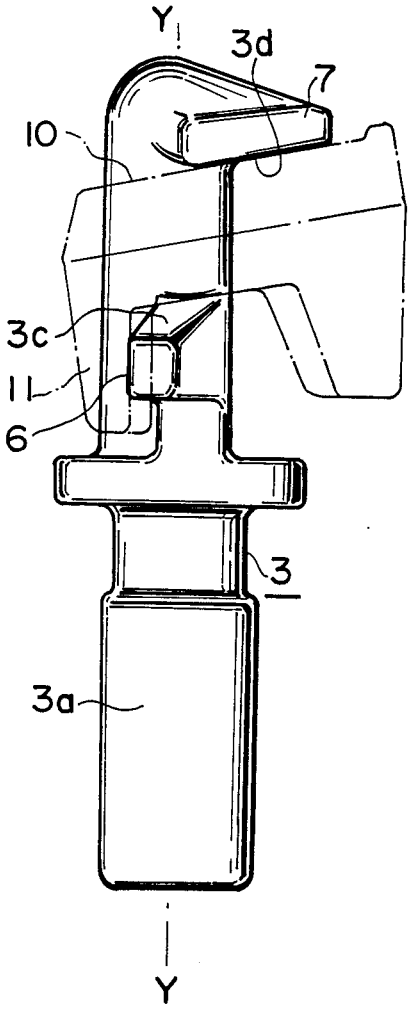
FIG. 6 is a right side view of the cam.
Figure 7:
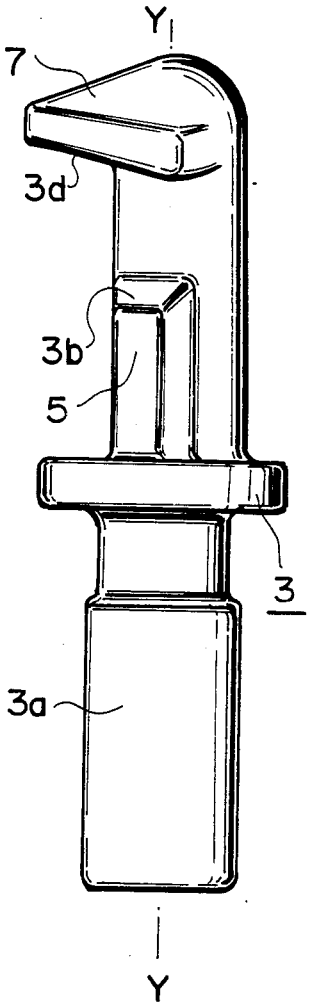
FIG. 7 is a left side view of the cam.

As shown in FIGS. 6 and 7, the sloped contacting lower surface 3*d* of projecting head 7 is formed at a selected angle from its base to its tip so as to specifically fit the sloped receiving surface 4*c* on the upper surface of the cam keeper 4 as seen in FIG. 2.

Figure 8:
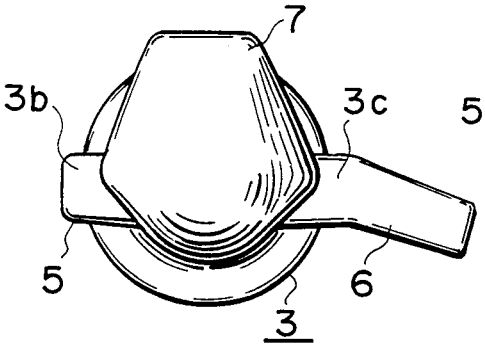
FIG. 8 is a plan view of the cam.
Figure 9:
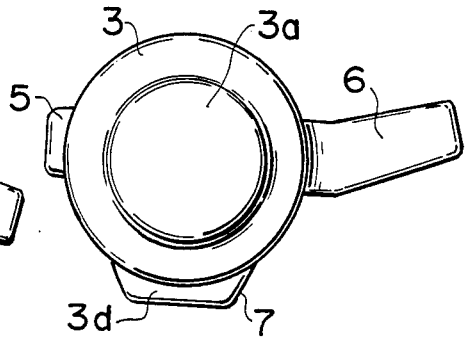
FIG. 9 is a bottom view of the cam.
Figure 10:
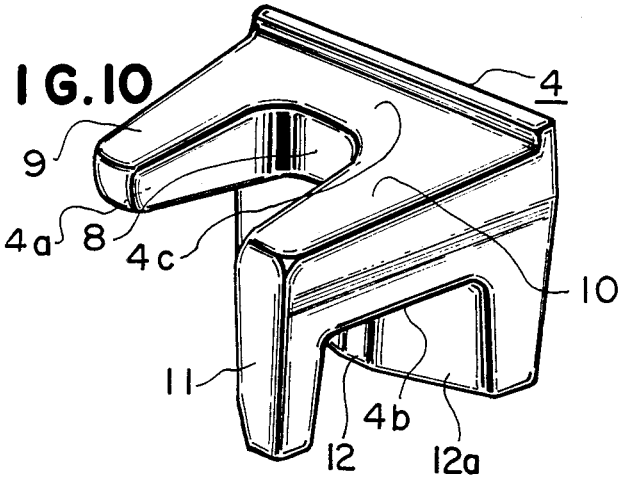
FIG. 10 is a perspective view of a cam keeper.
Figure 11:
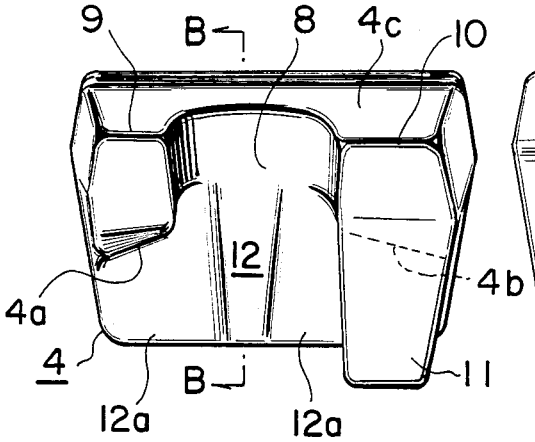
FIG. 11 is a front view of the cam keeper.
Figure 12:
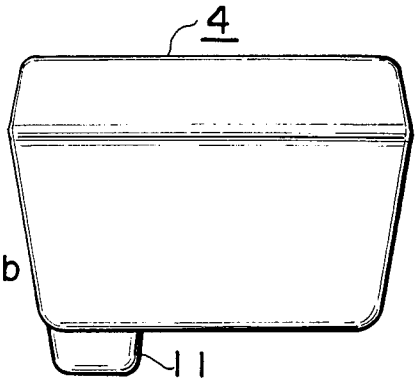
FIG. 12 is a back view of the cam keeper.
Figure 13:
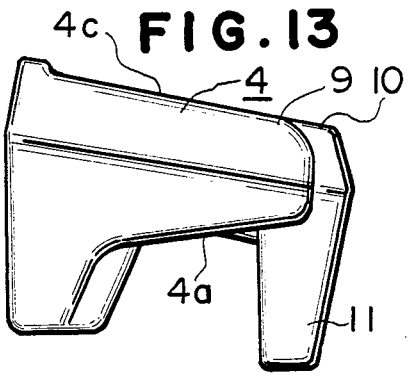
FIG. 13 is a left side view of the cam keeper.
Figure 14:
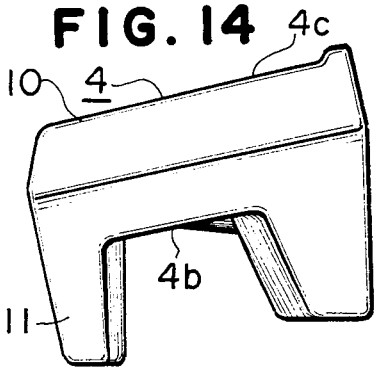
FIG. 14 is a right side view of the cam keeper.
Figure 15:
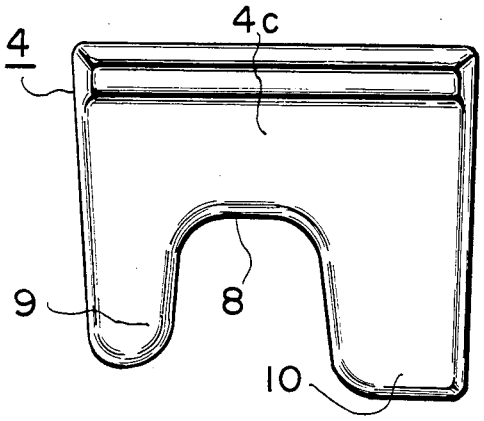
FIG. 15 is a plan view of the cam keeper.
Figure 16:
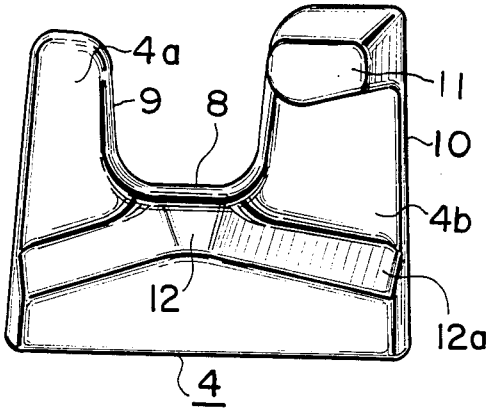
FIG. 16 is a bottom view of the cam keeper.

Further, the above mentioned fork 6 is formed to be curved rearward of the head 7 as in FIGS. 8 and 9.

The cam keeper 4 shall be described in the following. It is shown in detail in FIGS. 10 to 17.

The cam keeper 4 comprises a more or less rectilinear base plate having a U-shaped recess 8 to receive cam 3 formed substantially in the middle. The U-shaped recess is formed by a pair of generally perpendicular projecting arms 9 and 10. A sloped receiving surface 4*a* fitting the sloped contacting surface 3*b* of the engaging lobe 5 of the cam 3 is formed on the lower surface of a projecting arm 9. The projecting arm 10 is provided at its free end with a depending leg forming a hook 11 into which the fork 5 is inserted. The lower surface 4*b* of the arm 10 is sloped fitting the sloped contacting surface 3*c* of the fork 6.

Figure 18:
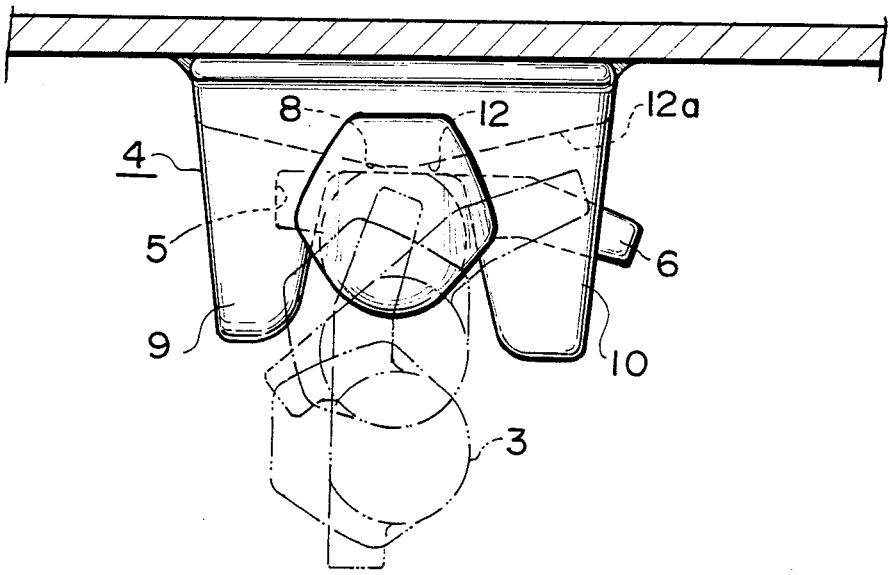
FIG. 18 is a plan view showing a process of engaging the cam keeper with the cam.

Further, the upper surface of the cam 4 is sloped to provide a receiving surface 4*c* fitting the contacting surface 3*d* on the lower surface of the head 7 of the cam 3. A ridge-shaped projecting portion 12 is formed as shown in plan in FIGS. 17 and 18 on both sides below and between the projecting arms 9 and 10 of the recess 8 so that, when the cam keeper 4 is to be engaged and disengaged by the cam 3, the tip end of the fork 6 will be guided on a sloped surface 12*a* formed outwardly from the ridge-shaped projecting portion 12 into the hook 11.

In the drawings, the reference numeral 13 denotes a lock lever to rotate the locking bar and 14 denotes its stopper.

Figure 20:
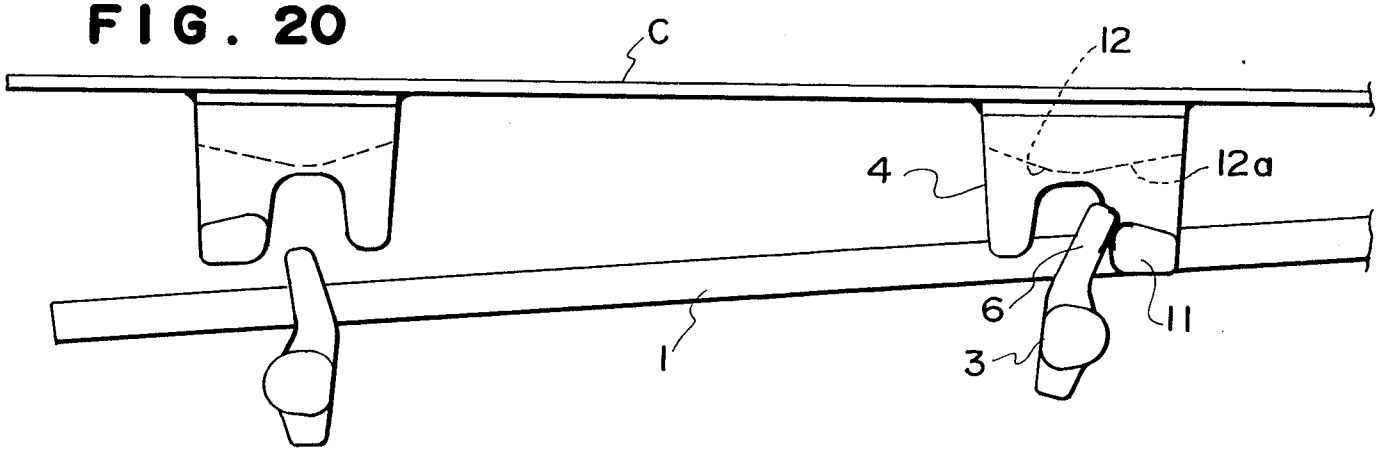
FIG. 20 is a view of the door as beginning to close.
Figure 21:
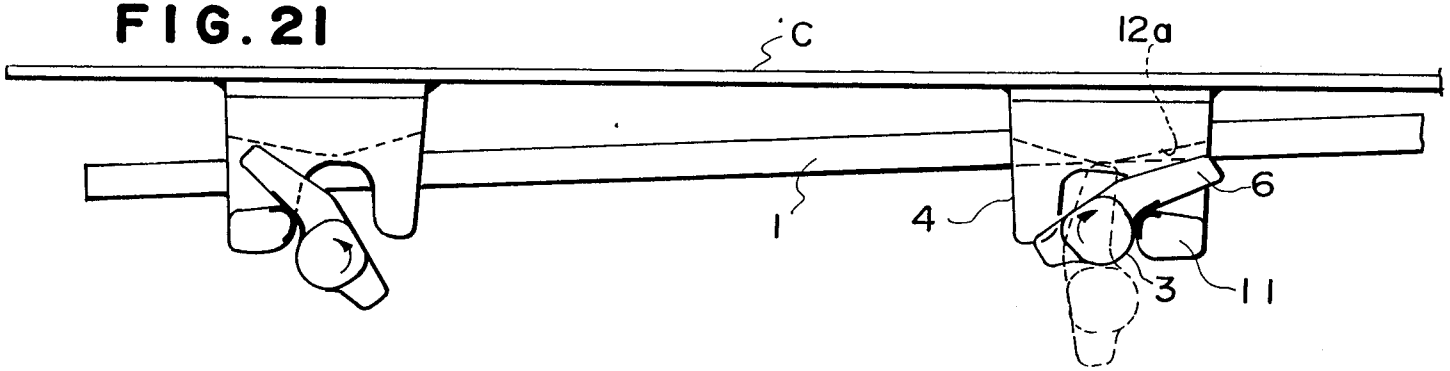
FIG. 21 is a view of the door as being closed.
Figure 22:
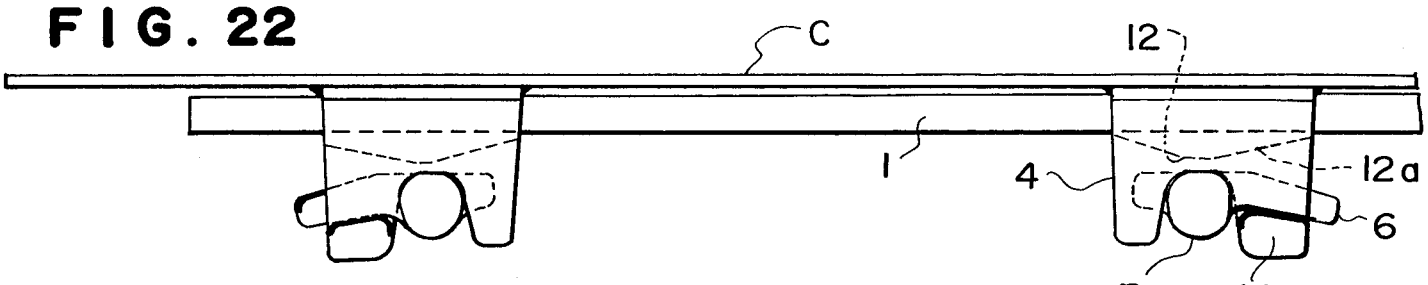
FIG. 22 is a view of the door as completely closed.

In the operation of the above mentioned formation, as seen in FIGS. 20 and 21, the cam 3 are arranged to face outwardly from the edge of the door 1 while the cam keepers 4 are arranged in opposition thereto at the top and bottom of the frames of the container. Thus, to close the door the bar of cam 3 is inserted in the recess 8 of the cam keeper 4 and the locking bar 2 is rotated with the lock lever 13 as seen in FIG. 1. The fork 6 of the cam 3 slides into engagement into the hook 11 and is stopped by the depending leg until it is finally stabilized in position as shown in FIG. 22.

When the lock lever 13 is then retained in its stopper 14, the locking bar cannot thereafter be naturally rotated and the door will not open by itself.

Figure 23:
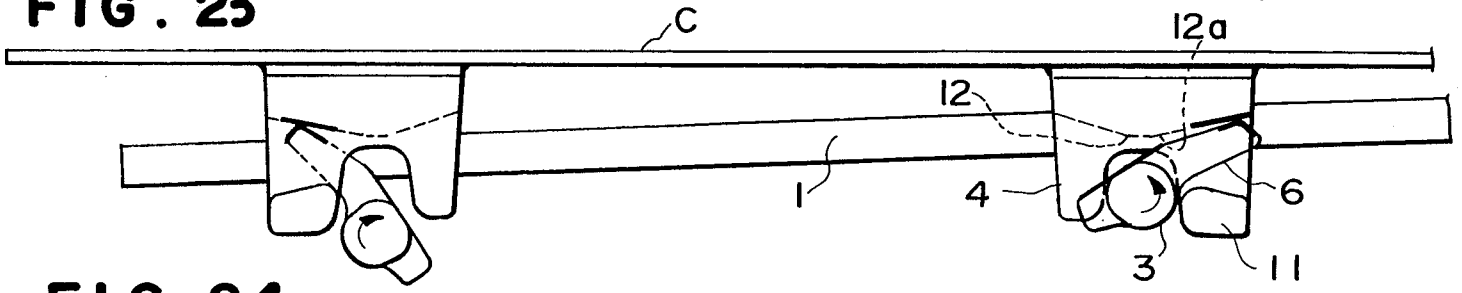
FIG. 23 is a view of the door as beginning to open.
Figure 24:
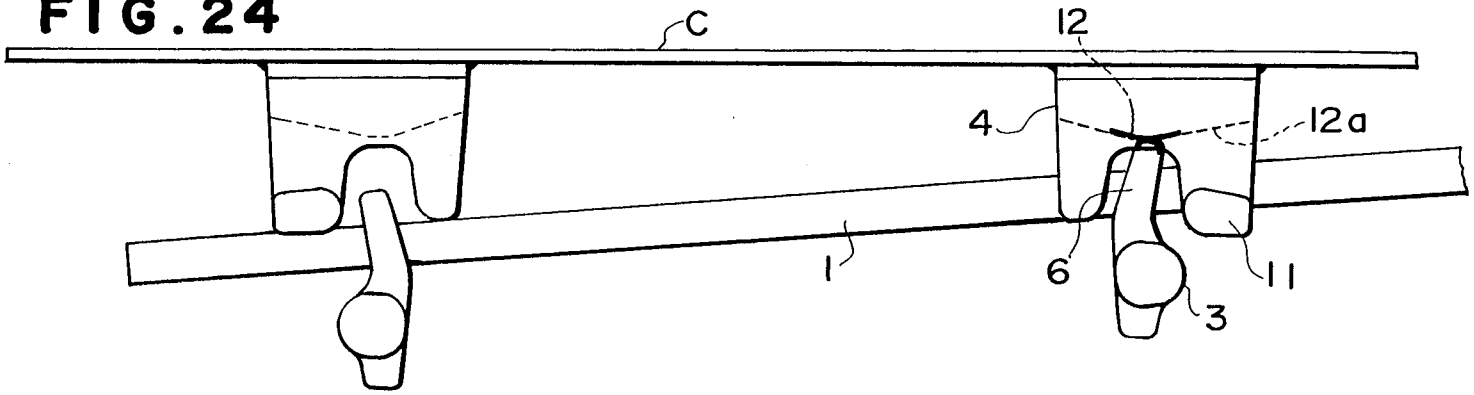
FIG. 24 is a view of the door as completely opened.

Now, in order to open the door 1, the lock lever 13 is disengaged from the stopper 14 and the locking bar 2 is counter rotated, reversing the movement of the lock lever 13 as in FIG. 23. The fork 6 of the cam 3 will slide on the sloped surface 12*a* outward of the cam keeper 4, becoming disengaged from the hook 11 and when the tip of the cam fork 6 rests on the projecting portion 12, the cam keeper 4 will be disengaged from the cam 3 and the door will be opened.

As seen in FIG. 4, since the sloped receiving surfaces 4*a* and 4*b* formed on the lower surfaces respectively of the projecting arms 9 and 10 of the cam keeper 4 are made to fit respectively with the sloped receiving surfaces 3*b* and 3*c* formed symmetrically on the upper surfaces of the engaging lobe 5 and fork 6 of the cam 3, the forces indicated by the arrows H will be produced which forces act against the force received in the axial direction of the locking bar 2 indicated for example by the arrow G, acting to push up the cam 3. Thus in the event a racking load is applied and concentrated on the axis X, the forces applied to the cam keeper 4 will be balanced on the right and left, at the same time. A force in the direction of closing of the door 1 will be applied to the door with a vector indicated by the arrow F' in FIG. 2 and the durability will improve.

Now, as shown in FIG. 2, a force indicated by the arrow I tending to push down on the cam 3 is overcome by the sloped receiving surface 4*c* on the upper surface of the cam keeper 4 cooperating with the sloped contacting surface 3*d* on the lower surface of the projecting head 7. The force from the cam 3 will be applied near to the base of the cam keeper 4 so that no over load will be applied to the tip. This balance is obtained by a force indicated by the arrow F acting toward the axis Y of the cam 3, produced as shown in FIG. 6 by the relation of the sloped contacting surface 3*d* and sloped receiving surface 4*c* which, on the other hand, will be controlled by the hook 11, creating a contrary force indicated by the arrow F' in the reverse direction and the device will be able to be fully stabilized.

Further, in the event that a so-called end wall load is applied from inside the door 1 a force is created which is the same as in the case when the cam 3 is pushed downwardly. However, in the present invention, the fork 6 will engage with the leg 11 and the hook 11 will act as a lever to prevent the door 1 from flexing outward.

As mentioned above, the present invention provides the effect of a door locking device which is most suitable particularly for containers and van type vehicles and with which locking can be very well balanced against the end wall load and racking load, the durability is high and the door is easy to open and close.

What is claimed:

1. A door locking device comprising a cam and a cam keeper, said cam comprising a generally cylindrical bar provided with a lobe and a fork radially extending therefrom substantially in opposition to each other, and a radially projecting head spaced above and radially offset from said lobe, said lobe and fork each having shaped upper surfaces inclined at symmetrical angles from the bar to their outer tips, said projecting head having a sloped lower surface extending from the bar to the outer tip thereof, said cam keeper comprising a baseplate having a pair of arms projecting perpendicularly thereto and forming a U-shaped recess for receiving said bar, the upper surface of each of said arms having a shape conforming to the slope of the lower surface of the projecting head of said cam on which said head fits, one of said projecting arms having a lower surface provided with a slope conforming to the slope on the upper surface of said lobe of said cam beneath which the lobe fits, the other projecting arm having a lower surface having a slope conforming to the slope on the upper surface of said fork, and a depending leg at the outer end of said other projecting arm forming with said baseplate a U-shaped hook extending substantially normal to said U-shaped recess into which said fork is inserted and retained.

2. The locking device according to claim 1, wherein the surface of the baseplate of said cam keeper is provided with a central ridge and a slope extending downwardly in the outward direction therefrom beneath said other of said projecting arms toward said hook.

3. The locking device according to claim 1, wherein said fork is further inclined in the direction transverse to its slope from the bar to the outer tip and said other projecting arm is conformingly inclined transversely to its direction of projection from the base plate.

* * * * *